United States Patent [19]

Moore

[11] Patent Number: 5,018,627

[45] Date of Patent: May 28, 1991

[54] RELATING TO SUPPORT RAILS

[75] Inventor: John A. Moore, Carrickfergus, Northern Ireland

[73] Assignee: Silver Systems Limited, Carrickfergus, Ireland

[21] Appl. No.: 599,453

[22] Filed: Oct. 18, 1990

[30] Foreign Application Priority Data

Oct. 18, 1989 [GB] United Kingdom ..... 8923480

[51] Int. Cl.[5] ..... A47F 5/00

[52] U.S. Cl. ..... 211/123; 211/7; 206/291

[58] Field of Search ..... 211/124, 123, 4, 7; 206/279, 289, 290, 291; 70/59, 62

[56] References Cited

U.S. PATENT DOCUMENTS

| | | | |
|---|---|---|---|
| 2,929,514 | 3/1960 | Stewart | 211/123 |
| 3,380,596 | 4/1968 | Cronl | 211/123 |
| 3,567,034 | 3/1971 | Mozelsio | 211/7 |
| 3,993,195 | 11/1976 | Caligiuri | 211/7 |
| 4,336,885 | 6/1982 | Thomas | 211/4 |
| 4,811,853 | 3/1989 | Mead et al. | 211/124 |

*Primary Examiner*—Robert W. Gibson, Jr.

*Attorney, Agent, or Firm*—Neuman, Williams, Anderson & Olson

[57] ABSTRACT

A support rail which may be used as a clothes support rail is provided, comprising an elongate support member and a plurality of means for receiving a hanger stem. The receiving means are mounted equidistantly along the length of the support member and enable an object, such as an article of clothing suspended from a clothes hook, to be supported therefrom. The receiving means each comprise a receptacle mounted to said elongate support member such that they are each movable between a first open position and a second closed position.

Placing the hanger stem of a hanging device within the receptacle causes the receptacle to move from its normal first open position to its second closed position. When in its said second closed position, no additional hanger stems can be placed in said receptacle.

A clothes rail comprising the support rail of the invention has the advantage of reducing the likelihood of displayed garments becoming clustered on the clothes rail after purchasers have firstly removed the garments from the rail and then replaced them.

11 Claims, 2 Drawing Sheets

RELATING TO SUPPORT RAILS

This invention relates to a support rail which is intended for use particularly, but not exclusively, as a clothes support rail.

Clothes support rails comprising at least an elongate beam spaced above the floor are in common use in retail outlets, for example. The clothes support rails are employed for hanging garments therefrom, using known clothes hangers, in order to display the garments to potential purchasers. In some instances the clothes support rails are inclined over their length and have a plurality of upwardly depending stops integrally formed therewith, to provide a plurality of hanging locations therebetween.

Often when a potential purchaser is examining a particular garment, suspended from a rail by a clothes hanger, they remove the garment and hanger from the rail and, having examined the garment, they then fail to rehang the garment and hanger at the location on the rail from which it was initially removed. This can result in displayed garments becoming untidily clustered on the rail. Garments replaced in this manner may also be easily knocked to the floor, thus becoming shop soiled.

A further problem encountered with known clothes support rails is where the displayed garments have been arranged in size order along the length of a rail. The failure of a potential purchaser to replace a garment, after examination, at the correct hanging location on the rail can result in an undesirable intermix of garment sizes. Retail outlet staff time may be needlessly consumed in rearranging said intermix of garment sizes into the correct order.

It is the intention of the present invention to obviate or mitigate the aforesaid disadvantages.

According to one aspect of the present invention there is provided a support means comprising a support member and at least one means for receiving a hanger stem; wherein the receiving means, in the form of a receptacle, is movable, relative to the support member, between a first open position and a second closed position; the receiving means is adapted to receive, in use, a hanger stem whereby when a hanger stem is placed in said receiving means, when in said first open position, the receiving means is caused to move to said second closed position, and when in said second closed position, further hanger stems are prevented from being placed therein.

Means for resiliently maintaining said receiving means in said first open position, when not in use, may be provided. The resilient means may be mounted between the receiving means and the support member, the resilient means being chosen such that when a hanger stem is placed in said receiving means, the weight of a hanging device, of which the hanger stem forms part, overcomes the resilient force applied by the resilient means and causes the receiving means to move to said second closed position.

The resilient means may comprise compression springs mounted between the support member and the receiving means and is adapted, in use, to act against the movement of the receiving means from its first open position to its second closed position.

Alternatively, the resilient means may comprise an elastic member attached between said receiving means and the support member.

The receiving means may be substantially square in cross-section with an upper portion thereof removed to form a recess which is adapted to receive, in use, a hanger stem.

The recess may be bound by a first upper lip which projects outwardly over the recess and prevents hanger stems from being placed in the receiving means when the receiving means is in its second closed position, and a second lower lip which acts to prevent a hanger stem from sliding out from the recess particularly whilst the receptacle is moving from its first open position to its second closed position.

Alternatively, the receiving may be substantially "Y" shaped in cross-section, with first and second arms thereof defining a recess capable of receiving, in use, a hanger stem.

According to a second aspect of the present invention there is provided a support means comprising a support member and at least one receiving means; wherein the receiving means is rotatably mounted upon said support member and is rotatably movable, relative to the support member, between a first open position and a second closed position, the receiving means is adapted to receive, in use, a hanger stem whereby when a hanger stem is placed in said receiving means, when in said first open position, the receiving means is caused to rotatably move to said second closed position and, when in said second closed position, further hanger stems are prevented from being placed therein.

The rotatable receiving means may be rotatably mounted upon the support member about a point above its centre of gravity, and such that, when not in use, it remains in equilibrium about said point maintaining the receiving means in the first open position.

Arrest means may be provided in association with the support member whereby the arrest means prevent the receiving means, when not in use, from rotating about said point, under the action of its own weight, beyond the first open position in a direction away from the second closed position.

According to a third aspect of the present invention there is provided a support means comprising a support member and at least one receiving means; wherein the receiving means is movable between a first open position and a second closed position in a direction generally perpendicular to the longitudinal axis of the support member; the receiving means is adapted to receive, in use, a hanger stem whereby when a hanger stem is placed in said receiving means, when in said first open position, the receiving is caused to move to said second closed position and, when in said second closed position, further hanger stems are prevented from being placed therein.

The support member may comprise an elongate beam having a number of cavities formed therein, each cavity adapted to accommodate a receiving means, in order to provide a number of discrete hanging locations from which objects, supported from known hanging devices, can be suspended.

The support member may be provided with fixture means to enable said support means to be mounted spaced from the floor and such that it may be mounted so as to be inclined over its length.

The foregoing and further features of the present invention may be more readily understood from the following description of a preferred embodiment, by way of example, and with reference to the accompanying drawings of which:

of such packages for the shipment, storage and/or display thereof.

A further primary object of the present invention is to provide such a package to be complementary-shaped to permit multiple alignment, so that one package is immediately adjacent to the next package, so that the packages may be easily and satisfactorily positioned and displayed on a shelf while minimizing lost or wasted space and maximizing the use of the space available.

In accordance with the teachings of the present invention, a package is disclosed for the display of batteries. This package includes a housing formed by a first blister and a second blister. The housing has a substantially diagonal seam formed therebetween for removably joining the first and second blisters to one another. Preferably, the seam is offset towards the first blister, such that the second blister is larger than the first blister. The housing is sized to receive therein at least two lower batteries disposed substantially horizontally therein in a side-by-side arrangement on top of the lower batteries.

Preferably, a header is joined to the housing being offset rearwardly thereon. In this manner, when supported by the header on, for example, a display rack, the first blister of the housing hangs downwardly. In this fashion, at least three of the batteries is displayed when the package is viewed.

It is further preferred that the housing be substantially quadrilateral (rhomboid) in shape, so that the housing is complementary-shaped. In this manner, multiple alignment of such packages with other such packages is permitted. This permits the packages to be immediately adjacent to the next package without wasting space therebetween.

These and other objects of the present invention will become apparent from the following specification, when taken in conjunction with the enclosed figures.

BRIEF DESCRIPTION OF THE DRAWINGS

FIGS. 6A–6B illustrate the disposal of the packages on a rack for the display thereof by being hung by the header.

FIG. 7 is a rear view of the package showing the two-layer construction of the header and how the user thereof separates the two layers of the header for opening the package.

FIG. 8 shows how the packages are disposed in a carton with the headers bent over the respective housings of the various packages for the shipment thereof.

DESCRIPTION OF PREFERRED EMBODIMENTS

Figure 1:
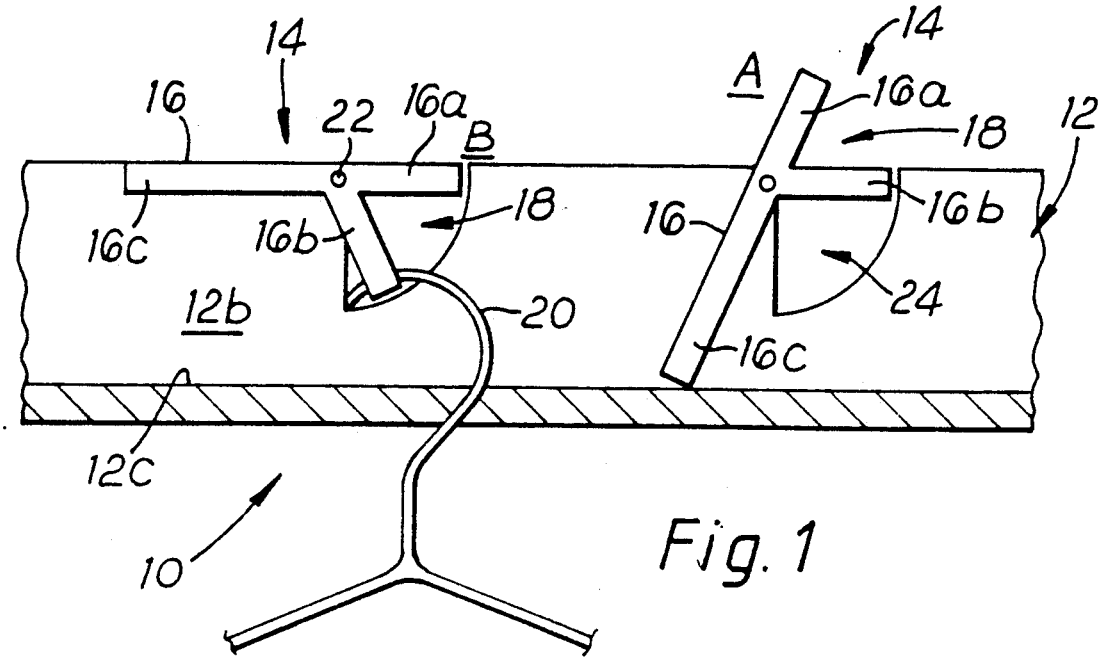
FIG. 1 is a front perspective view of the package of the present invention.
Figure 2:
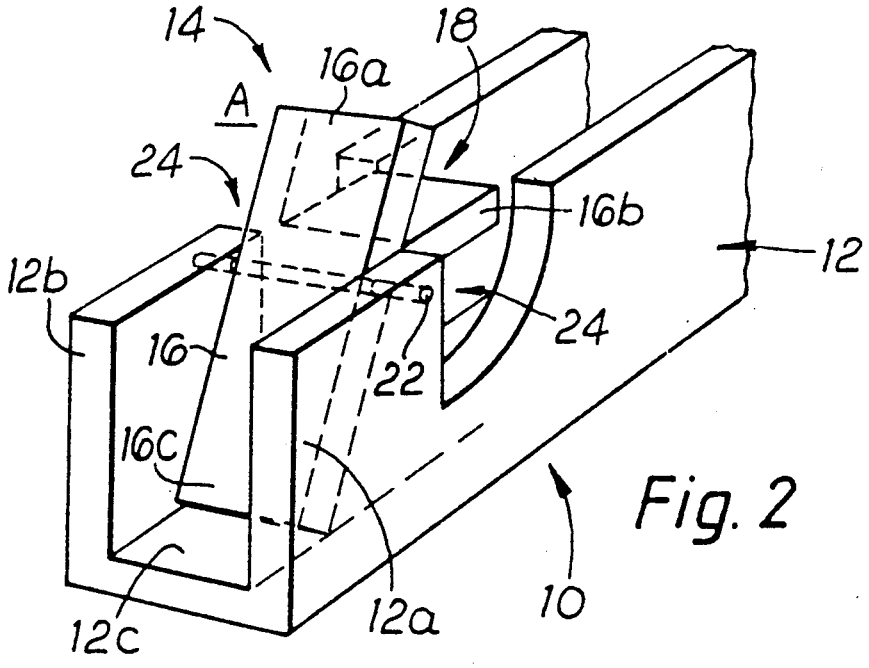
FIG. 2 is a rear perspective view of the package of the present invention.
Figure 3:
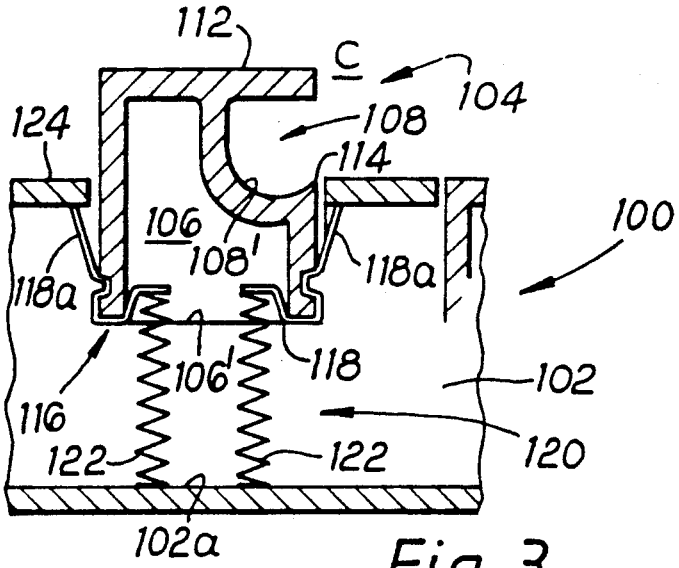
FIG. 3 is a side view of the package showing, in phantom lines, the alternative positioning of the header and the pivoting of the header when provided with a living hinge.

Referring now to the drawings, and in particular, to FIGS. 1–3, the package 10 is a blister package for displaying four batteries 1 therein. The package 10 includes a housing 11 formed by a front (first) blister 12 and a rear (second) blister 13. The front and rear blisters 12 and 13, respectively are removably joined to one another along a substantially diagonal seam 14. Also joined to the housing 11 is a header 15 that extends substantially upwardly therefrom.

The various components 12, 13 and 15 of the package 10 are fabricated from a transparent, heavy gauge, thermoplastic material. An example of such is cold crack resistant polyvinyl chloride. Preferably, the thermoplastic sheets are about 0.014 inches thick.

The housing 11 of the package 10 is sized to receive therein a pair (at least two) of lower batteries that are disposed substantially horizontally therein in a side-by-side arrangement. In this respect, one of the two lower batteries (the lower forward battery) is positioned forwardly in front of the other of the two lower batteries (the lower rearward battery). The housing 11 is further sized to receive therein a pair (at least two) of upper batteries that are also disposed substantially horizontally therein in a side-by-side arrangement on top of the lower batteries. In this respect, one of the two upper batteries (the upper rearward battery) is positioned rearwardly behind the other of the two upper batteries (the upper forward battery).

Each of the batteries 1 mentioned above has a midpoint that is coincident with the terminal of the respective battery. It is noted that the lateral width of the package 10 when the batteries are horizontally disposed or oriented is less than the lateral width of a package when three batteries are vertically disposed or oriented. Generally the overall lateral width of the package 10 is reduced so that four packages fit in the space that three packages of the prior art would occupy.

Preferably, the seam 14 is not centered but is offset towards the front blister 12, such that the rear blister 13 is larger than the front blister 12. In this respect, it is especially preferred that the diagonal seam 14 extends from the upper rear of the package 10 to the lower front and intersects the one of the two upper batteries (the upper rearward battery) forwardly of the midpoint thereof, and further that the diagonal seam 14 intersects the one of the two lower batteries (the lower forward battery) at the midpoint thereof. Furthermore, this offset seam 14 provides a rear blister 13 that can hold all of the batteries 1 therein, so that during manufacture the batteries 1 are stacked in the rear blister 13 while it is horizontal. The front blister 12 may then be placed over the rear blister 13 and the batteries 1 therein and be welded (by, for example, radio frequency welding, ultrasonic welding or heat sealing) thereto along the said seam 14.

It is noted that, preferably, the housing 11 is substantially quadrilateral (rhomboid, rectangular or square) in shape having an upper rear and upper front as well as a lower rear and a lower front. In this fashion, the housings 11 are complementary-shaped permitting the multiple alignment thereof with other such packages. This permits each of the packages 10 to be positioned immediately adjacent to the next package without wasting space therebetween (see, in particular, FIGS. 4–5 and 8).

Additionally, when a garment is purchased, the receptacle at the location on the clothes rail from which it is removed will sit open indicating to shop staff that a replacement garment could be suspended therefrom and in this way aid shop staff in keeping such clothes rails well stocked.

The clothes rail may be inclined over its length and on placing a hanger stem over the rail, at a position above a receptacle, would allow the hanger stem to slide down the rail and engage with the receptacle and cause it to close securing the hanger stem therein.

In another not shown embodiment the receptacles may each, or communally have, associated therewith a locking means to prevent the hanger devices being removed from the clothes rail.

I claim:

1. A support means comprising a support member and at least one receiving means; wherein the receiving means is movable, relative to the support member, between a first open position and a second closed position; the receiving means is adapted to receive, in use, a hanger stem whereby when a hanger stem is placed in said receiving means, when in said first open position, the receiving means is caused to move to said second closed position, and when in said second position, further hanger stems are prevented from being placed therein.

2. A support means as claimed in claim 1 including means, for resiliently maintaining said receiving means in said first open position, when not in use, such means being mounted between the receiving means and the support member.

3. A support means as claimed in claim 2 wherein the resilient means comprise compression springs mounted between the support member and the receiving means.

4. A support means as claimed in claim 1 wherein the receiving means is substantially square in cross-section having an upper portion thereof removed to form a recess which is adapted to receive, in use, a hanger stem.

5. A support means as claimed in claim 4 wherein the recess is bounded by a first upper lip, which projects outwardly over the recess and a second lower lip which curves upwardly from the base of the recess.

6. A support means as claimed in any of claim 1 wherein the receiving means is substantially "Y" shaped in cross-section, with first and second arms thereof defining a recess capable of receiving, in use, a hanger stem.

7. A support means comprising a support member and at least one receiving means; wherein the receiving means is rotatably mounted upon said support member and is rotatably movable, relative to the support member, between a first open position and a second closed position; the receiving means is adapted to receive, in use, a hanger stem whereby when a hanger stem is placed in said receiving means, when in said first open position, the receiving means is caused to rotatably move to said second closed position and, when in said second closed position, further hanger stems are prevented from being placed therein.

8. A support means as claimed in claim 7 wherein the rotatable receiving means is rotatably mounted upon the support member about a point above its centre of gravity.

9. A support means as claimed in claim 8 wherein arrest means are provided whereby the arrest means prevent the receiving means, when not in use, from rotating about said point, under the action of its own weight, beyond the first open position in a direction away from the second closed position.

10. A support means comprising a support member and at least one receiving means; wherein the receiving means is movable between a first open position and a second closed position in a direction generally perpendicular to the longitudinal axis of the support member; the receiving means is adapted to receive, in use, a hanger stem whereby when a hanger stem is placed in said receiving means, when in said first open position, the receiving means is caused to move to said second closed position and, when in said second closed position, further hanger stems are prevented from being placed therein.

11. A support means as claimed in claim 1 wherein the support member comprises an elongate beam having a number of cavities formed therein, each cavity adapted to accommodate a receiving means, in order to provide a number of discrete hanging locations from which objects, supported from known hanging devices, can be suspended.

* * * * *

UNITED STATES PATENT AND TRADEMARK OFFICE

CERTIFICATE OF CORRECTION

PATENT NO. : 5,018,627

DATED : May 28, 1991

INVENTOR(S) : John A. Moore

It is certified that error appears in the above-identified patent and that said Letters Patent is hereby corrected as shown below:

Columns 3 and 4 should be deleted to appear as per attached columns 3 and 4

Signed and Sealed this

Twenty-ninth Day of September, 1992

*Attest:*

DOUGLAS B. COMER

*Attesting Officer*

*Acting Commissioner of Patents and Trademarks*

Figure 4:
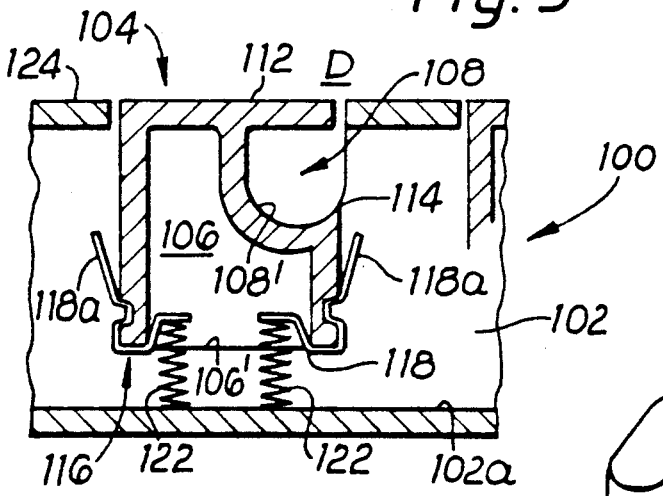
FIG. 4 illustrates the disposal of the packages on a shelf for the display thereof in multiple alignment, so that one package is immediately adjacent to the next package without wasting any space therebetween.
Figure 5:
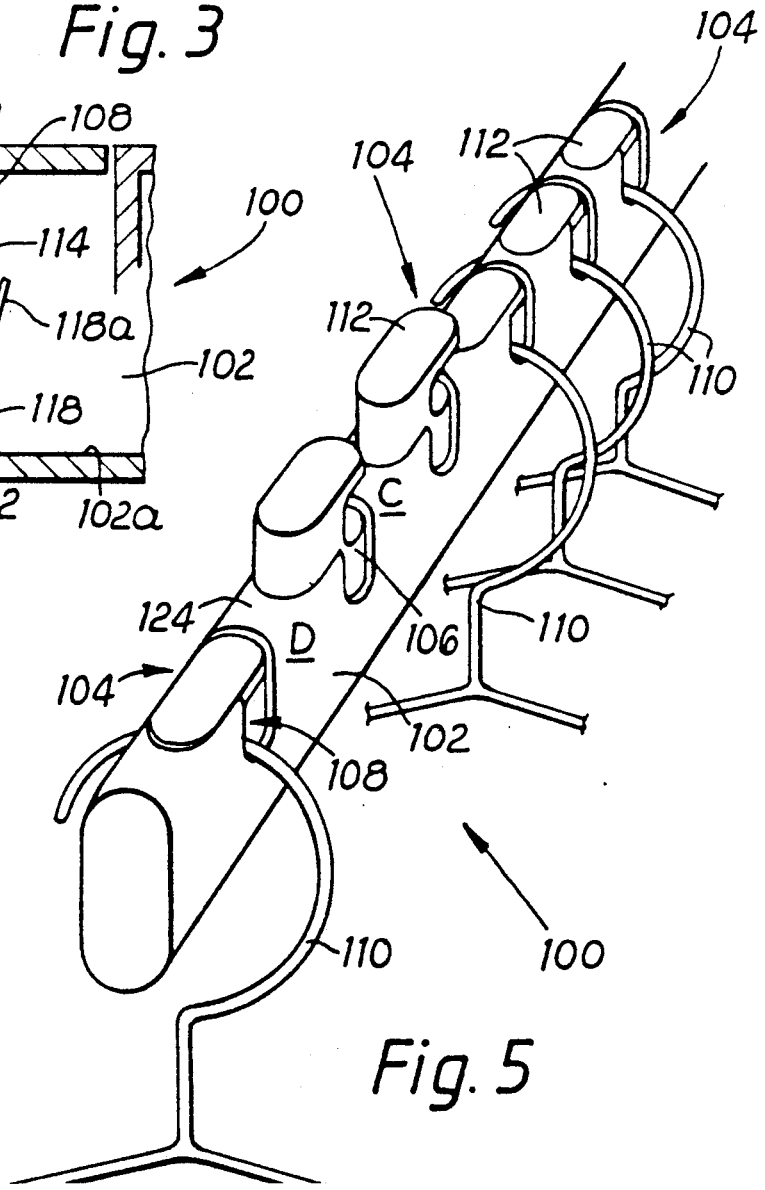
FIG. 5 corresponds substantially to FIG. 4 and further shows how the packages are stacked on one another during the storage or display thereof.

FIG. 1 is a side sectional view of a portion of a support means according to one aspect of the invention;

FIG. 2 is an end elevational view of a portion of the support means of FIG. 1;

FIG. 3 is a side sectional view of a portion of an alternative support means showing a receiving means in a first open position;

FIG. 4 is a side sectional view of a portion of the support means of FIG. 3 showing the receiving means in a second closed position; and FIG. 5 is an end elevational view of a portion of the support means of FIGS. 3 and 4.

Referring to the drawings, FIGS. 1 and 2 show a side sectional view of a portion of a support means 10. The support means 10 comprises an elongate support member 12, generally "U" shaped in transverse cross-section. Located between uprights 12 *a,b* of the support member 12, and spaced apart along said member 12, are a number of receiving means in the form of hanger receptacles 14.

The hanger receptacles 14 are rotatably mounted between said uprights 12*a,b* and are each movable between a first open position A and a second closed position B.

The receptacles are each comprised of a substantially "Y" shaped member 16, first and second upper arms 16*a,b* of which define a recess 18 capable of receiving, in use, a hanger stem 20. A hanger stem 20 forms part of a hanger device (not shown) which can be used to suspend objects such as articles of clothing therefrom.

Each receptacle 14 is rotatably mounted to support member 12 at a point 22 above its centre of gravity and such that the receptacle 14 remains in its first open position A when not in use. The receptacle 14 is prevented from moving beyond its first open position A in a direction away from the second closed position B by means of the lower portion 16*c* of the member 16 abutting the base 12*c* of the support member 12.

Each upright 12*a,b* of the support member 12 has portions cut away to provide slots 24 adjacent to each side of each receptacle 14. The slots 24 enable a receptacle 14 to move from its first open position A to its second closed position B with the hanger stem 20 placed in the recess 18 thereof.

In use, a hanger stem 20 placed in the recess 18 of a receptacle 14 causes the receptacle 14 to counter-balance and move from its first open position A to its second closed position B. The first upper arm 16*a* prevents further hanger stems 20 from being placed in the recess 18 of the receptacle 14 when in its second closed position B.

In a not shown embodiment, the receptacles 14 may be resiliently maintained in said first open position A, when not in use, by means of springs, for example. The receptacle 14 may be prevented from travelling beyond the first open position A by stops (not shown) located on at least one of the uprights 12*a,b*, a stop being located adjacent to each of the receptacles 14.

FIGS. 3, 4 and 5 show a portion of an alternative support means 100. The support means 100 comprises an elongate support member 102 and a number of hanger receptacles 104 equally spaced therealong.

The hanger receptacles 104 are accommodated within the body of the support member 102 and are arranged such that they are each moveable, in a direction perpendicular to the longitudinal axis of the member 102, between a first open position C (FIG. 3) and a second closed position D (FIG. 4).

The receptacles 104 are each comprised of a member 106 which is substantially square in longitudinal cross-section. Each receptacle 104 has a portion cut away in an upper corner thereof to provide a recess 108, which is adapted to receive, in use, a hanger stem 110. The recess 108 is bounded bY a first upper lip 112 which extends longitudinally over the recess 108 and a lower lip 114 which curves upwardly from a base 108' of the recess 108.

The upper lip 112 prevents further hanger stems 110 from being placed in the recess 108 when receptacle 104 is in its second closed position D. The lower lip 114 acts to prevent the hanger stem 110 from sliding out of the recess 108, particularly, when the receptacle 104 is moving from its first open position C to its second closed position D.

Attached to a base 106' of each receptacle 104 is a retaining means 116 in the form of a retaining clip 118. The retaining clip 118 has at least one upwardly depending leg 118*a*.

A resilient means 120 in the form of a pair of compression springs 122 are mounted between the base 16' of the receptacle 104 and the base 102' of the support member 102. The resilient means 120 acts to maintain the receptacle 104 in the first open position C, when not in use.

In use, a hanger stem 110 is placed in the recess 108 of a receptacle 104. The weight of the hanging device (not shown), of which the hanger stem 110 forms part, causes the receptacle 104 to move from its first open position C to its second closed position D. When the receptacle 104 is in its second closed position D, the upper lip 112 lies coincident with the top surface 124 of the support member 102 and thereby acts to prevent any further hanger stems 110 from being placed in the recess 108 of the receptacle 104. The weight of the hanger device is sufficient to overcome the resilient force exerted by the springs 122 on the base of the receptacle 104.

When a hanger stem 110 is removed from the receptacle 104, the receptacle 104 is urged towards the first open position C by the resilient force exerted by the springs 122. The legs 118*a* of the retaining clip 118 act against the underside of the upper surface 124 of the member 102 and prevents the receptacle 104 from progressing past the first open position C.

In the context of the invention, a hanger stem 20, 110 is understood to comprise that part of a hanging device by which the device is normally suspended, for example, the upper curved hook of a clothes hanger. It is further understood that the description of a hanger stem 20, 110 being placed within a hanger receptacle 14, 104 of a support means 12, 102 does not require, in all circumstances, that the whole of the hanger stem 20, 110 should be placed within the receptacle 14, 104, but includes any portion of the stem 20, 110 that will enable the hanger device, of which the stem 20, 110 forms part, to be adequately suspended.

A clothes rail comprising a support means according to present invention has the advantage that it prevents the likelihood of garments being clustered on the rail by providing an individual hanging location for each displayed garment. This encourages potential purchasers to replace removed garments at the locations from which they were initially removed. It also has the added advantage that the displayed garments tend to be maintained in size order as originally displayed.